US009243395B2

(12) United States Patent
Dal Canto et al.

(10) Patent No.: US 9,243,395 B2
(45) Date of Patent: Jan. 26, 2016

(54) WASTE WATER LIFTING INSTALLATION

(71) Applicants: Riccardo Dal Canto, Leghorn (IT); Alessandro Iacoponi, Pisa (IT); Ralf Schomäcker, Bielefeld (DE)

(72) Inventors: Riccardo Dal Canto, Leghorn (IT); Alessandro Iacoponi, Pisa (IT); Ralf Schomäcker, Bielefeld (DE)

(73) Assignee: GRUNDFOS HOLDING A/S, Bjerringbro (DK)

( * ) Notice: Subject to any disclaimer, the term of this patent is extended or adjusted under 35 U.S.C. 154(b) by 615 days.

(21) Appl. No.: 13/624,426

(22) Filed: Sep. 21, 2012

(65) Prior Publication Data

US 2013/0074950 A1 Mar. 28, 2013

(30) Foreign Application Priority Data

Sep. 22, 2011 (EP) ..... 11182391

(51) Int. Cl.

| | |
|---|---|
| ***E03F 5/22*** | (2006.01) |
| ***F04D 13/06*** | (2006.01) |
| ***F04D 15/00*** | (2006.01) |
| ***F04D 15/02*** | (2006.01) |
| ***E03C 1/122*** | (2006.01) |
| *F04D 13/16* | (2006.01) |

(52) U.S. Cl.

CPC ..... *E03F 5/22* (2013.01); *E03C 1/1227* (2013.01); *F04D 15/0218* (2013.01); *F04D 13/16* (2013.01); *Y10T 137/6851* (2015.04)

(58) Field of Classification Search

CPC ..... F24F 13/22; F04D 13/16; F04D 15/0218; F04D 15/0227; E03F 5/22

USPC ..... 417/36, 40

See application file for complete search history.

(56) References Cited

U.S. PATENT DOCUMENTS

| | | | | |
|---|---|---|---|---|
| 5,103,793 | A * | 4/1992 | Riese et al. | 123/516 |
| 6,322,326 | B1 * | 11/2001 | Davis et al. | 417/40 |
| 2006/0228222 | A1 | 10/2006 | Pohler | |
| 2007/0224050 | A1 * | 9/2007 | Ward | 417/41 |

FOREIGN PATENT DOCUMENTS

| | | | |
|---|---|---|---|
| DE | 31 13 903 | A1 | 10/1982 |

* cited by examiner

*Primary Examiner* — Peter J Bertheaud

(74) *Attorney, Agent, or Firm* — McGlew and Tuttle, P.C.

(57) ABSTRACT

A waste water lifting installation includes a collection container (2) and a flange plate (4) which is arranged on the upper side of the collection container (2) and on which a level switch (12) immersing into the collection container (2) is attached. At least one run-in pipe (22), departing from the flange plate (4), extends vertically downwards into the collection container (2) and has such a vertical length that the lower end (28) of the run-in pipe (22) is vertically distanced further from the flange plate (4) than a lower end of the level switch (14).

19 Claims, 3 Drawing Sheets

WASTE WATER LIFTING INSTALLATION

CROSS REFERENCE TO RELATED APPLICATIONS

This application claims the benefit of priority under 35 U.S.C. §119 of European Application No. 11182391.0 filed Sep. 22, 2011, the entire contents of which are incorporated herein by reference.

FIELD OF THE INVENTION

The invention relates to a waste water lifting installation with a collection container and with a flange plate which is arranged on the upper side of the collection container and on which a level switch immersing into the collection container is attached.

BACKGROUND OF THE INVENTION

Waste water lifting installations (waste water sump installations) are used, in order to pump waste water which occurs below the level of the existing waste water conduits or the sewage system, to the higher level of the water-water conduit or sewage system.

Such waste water lifting installations mostly have a collection container, into which the waste water to be lifted or pumped flows. A pump, which pumps the waste water out of the collection container when the filled level of the collection container has reached a defined level, is located in the collection container. Usually, a level switch is provided in the collection container for switching the pump on and off. The level switch and pump thereby are often assembled on the cover or a flange plate which is placed onto the upper side of the connection container. For maintenance purposes, the flange plate may be removed from the collection container, wherein the level switch and the pump assembly may be removed with the flange plate out of the collection container. Thereby, it is problematic that the level switch, which is mostly designed as a float switch, may be easily damaged when the thus removed flange plate with the level switch is put down outside the collection container.

SUMMARY OF THE INVENTION

With regard to this problem, it is an object of the invention to create an improved waste water lifting installation, with which the level switch is protected from damage in an improved manner.

The waste water lifting installation according to the invention comprises a collection container. The waste water to be lifted or to be pumped to a higher level flows into this. On reaching a defined level, a pump in the waste water lifting installation is then switched on, in order to pump the water out of the collection container to a higher level. For this, a level switch immersing into the collection container is provided, and this level switch may switch a pump on and off in dependence on the water level in the inside of the collection container. According to the invention, a flange plate or a cover is arranged on the upper side of the collection container, on which flange plate or cover the level switch is attached such that it immerses into the collection container. The level switch may in particular be designed as a float switch which comprises a float body arranged in the collection container. The float body in the known manner is coupled to a switch mechanism for switching the pump on and off on reaching defined fluid levels. This may for example be a mechanical coupling which actuates an electrical switch contact. According to the invention, one now provides at least one run-in pipe extending vertically downwards into the collection container, in a manner departing from the flange plate. This run-in pipe serves as a feed for the waste water into the collection container. For this, the run-in pipe at its upper side, i.e. in the region of the flange plate or above the flange plate, is connected to an incoming conduit. According to the invention, the at least one run-in pipe has such a vertical length, that the lower end of the run-in pipe is distanced vertically further from the flange plate than a lower end of the level switch. A construction unit or module comprising the flange plate and the level switch terminates not at the level switch, but at the lower end of the run-on pipe. When the flange plate is put down outside the collection container, damage to the level switch on account of external force application may be avoided.

Preferably, several, particularly three or four run-in pipes are arranged on the flange plate and, departing from the flange plate, extend into the collection container, wherein the run-in pipes have such a vertical length, that their lower ends are in each case distanced vertically further from the flange plate that a lower end of the level switch. Preferably, these several run-in pipes are distanced from one another such that the construction unit comprising the flange plate, level switch and further components as the case may be, may stand in a stable manner on the lower end of the run-in pipes, without the level switch contacting the surface, on which the construction unit is placed. Damage to the level switch may thus be prevented. Preferably, four run-in pipes are arranged at four corners of an essentially rectangular flange plate which are distanced to one another. With the arrangement of several run-in pipes, it is not absolutely necessary for each run-in pipe to serve actually as a run-in or feed. Rather, the several run-in pipes may optionally form feeds to be connected, so that for example a feed conduit may be selectively connected to one of the run-in pipes, depending on where and how the waste water lifting installation is set up and how the waste water conduits to be connected are situated. Thus for example feeds to be optionally connected from different directions may be provided.

Particularly preferably, the flange plate also carries the pump assembly, i.e. an electrical motor with a pump, in particular a centrifugal pump. The pump is preferably designed such that the impeller immerses into the collection container and the electric motor is situated above the flange plate, wherein the electric motor and the impeller are connected to one another via a shaft.

Preferably, the lower end of the at least one run-in pipe or the lower ends of the several run-in pipes form the lowermost point or the lowermost points of all components attached on the flange plate. By way of this, when the flange plate with the components fastened on it, is put down onto the lower end of the run-in pipes, one succeeds in the remaining components arranged on the flange plate not coming into contact with the set-up surface and thus not being able to become damaged when being set up.

According to a further preferred embodiment, the at least one run-in pipe comprises at least one exit opening vertically distanced to its lower end. By way of this design, one succeeds in the exit opening from the run-in pipe into the collection container not being displaced too far to the bottom despite the extension of the run-in pipe downwards, as is envisaged according to the invention. An undesired blocking of the exit opening, for example due to the accumulation of contamination on the base of the collection container, may be prevented in this manner.

Further preferably, the at least one run-in pipe has a closed end-wall and at least one exit opening situated in a peripheral wall of the run-in pipe. Thereby, the end-wall is situated distanced vertically downwards from the flange plate and thus closes the flow path formed by the run-in pipe, to the bottom. The end-wall is thus situated preferably in the vicinity of the lower end of the run-in pipe. i.e. closer to the lower end than to the flange plate. One prevents contamination from being able to enter into the exit opening when the flange plate with the components attached to it is placed onto the lower end of the run-in pipes, due to the fact that the exit opening is simultaneously situated in the peripheral wall.

For this, the at least one run-in pipe preferably comprises a foot element which extends from the end-wall vertically downwards to the lower end of the run-in pipe, i.e. the foot element forms the actual lower end of the run-in pipe. This foot element may for example be designed as a sleeve or projection which extends vertically downwards from the end-wall. The foot element on its lower side preferably has a plane set-up (placement) surface, in order to ensure a stable standing on being put down.

Particularly preferably, the at least one run-in pipe is designed as one piece with the flange plate, preferably of plastic. Thus the at least one run-in pipe or preferably all run-in pipes may be manufactured in one working run together with the flange plate, for example as an injection molded part.

Further preferably, the at least one run-in pipe with its lower end engages into a run-in chamber of the collection container and together with this forms a gas closure or gas block. The run-in chamber of the collection container is preferably designed such that a run-in chamber which is only open to the top is formed by a wall extending upwards from the base of the collection container. The lower end of the run-in pipe engages from above into this run-in chamber such that the exit opening of the run-in pipe is situated below the upper edge of the run-in chamber open to the top. Thus a gas block in the manner of a siphon is created, which prevents a flow of gases through the run-in pipe into the collection container. This is particularly important when the waste water lifting installation is applied onto a heating installation as a condensate lifting installation, in order to pump away the condensate occurring in the waste gas of the heating installation. With this application, there is the danger that the waste gas from the heating installation flows into the collection container.

Further preferably, the at least one run-in pipe at its upper end may comprise at least one gas exit opening, in order to prevent the exit of the gas. Gas which flows in through a feed conduit connected to the run-in pipe, may be led to the outside through the gas exit opening into the surroundings, if it may no longer continue to flow into the collection container, for example due to the gas block.

The gas exit opening is preferably formed between a seal inserted into the upper end of the run-in pipe and a peripheral wall of the run-in pipe. Here, a recess or a gap may be provided, through which gas may exit to the outside. The seal preferably bears in a sealing manner on the outer periphery of a feed pipe or connection pipe, which is inserted into the run-in pipe, or may be brought into sealing bearing contact on the outer periphery of such a pipe. Thus such a feed pipe or connection pipe may be easily stuck into the run-in pipe and thus sealingly connected.

Particularly preferably, the waste water lifting installation is designed as a condensate lifting installation for application in a heating installation and/or air-conditioning installation. Condensed water occurs in air-conditioning and heating installations, in particular in calorific heating installations, and this condensation water often needs to be pumped to a higher level. In particular, condensate lifting installations for heating installations must be designed such that they are resistant to chemical compounds which are contained in the condensate, in particular with regard to the mostly acidic pH-value of the condensate.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
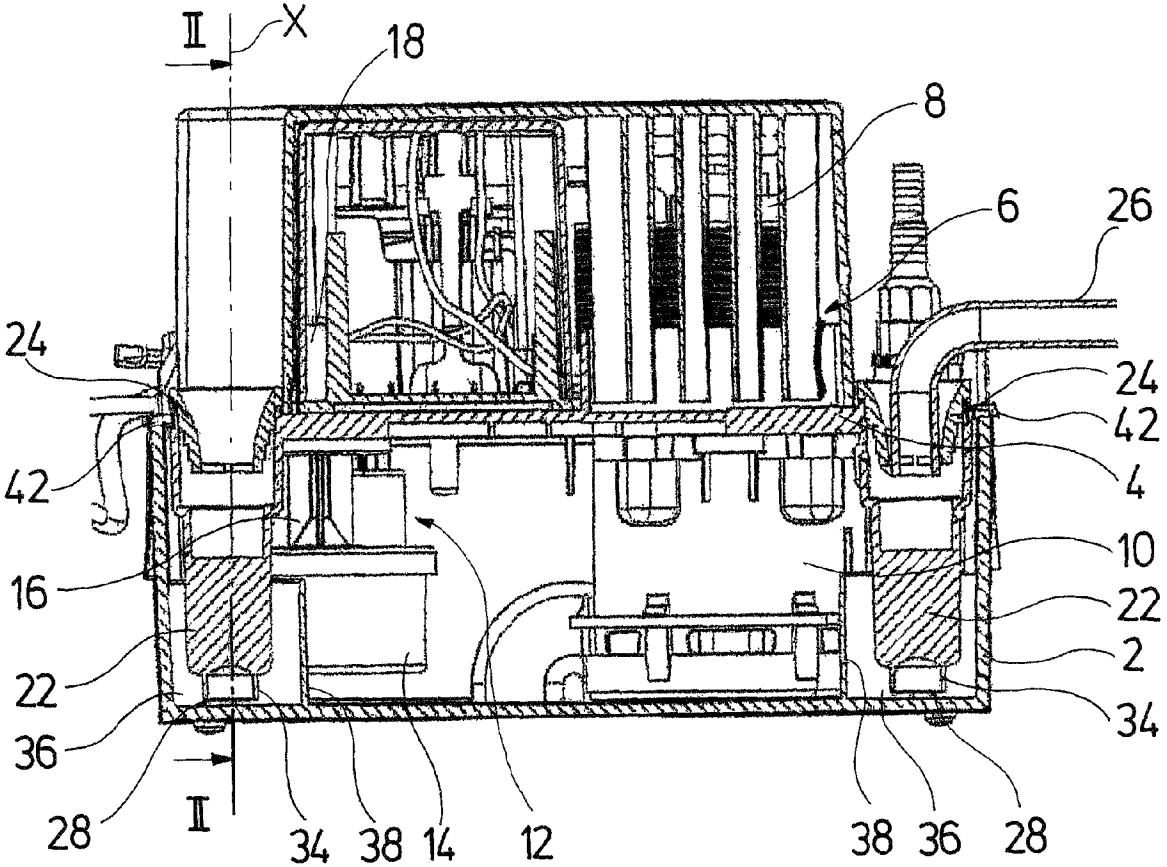
FIG. 1 is a sectioned view of a waste water lifting installation according to the invention.
Figure 2:
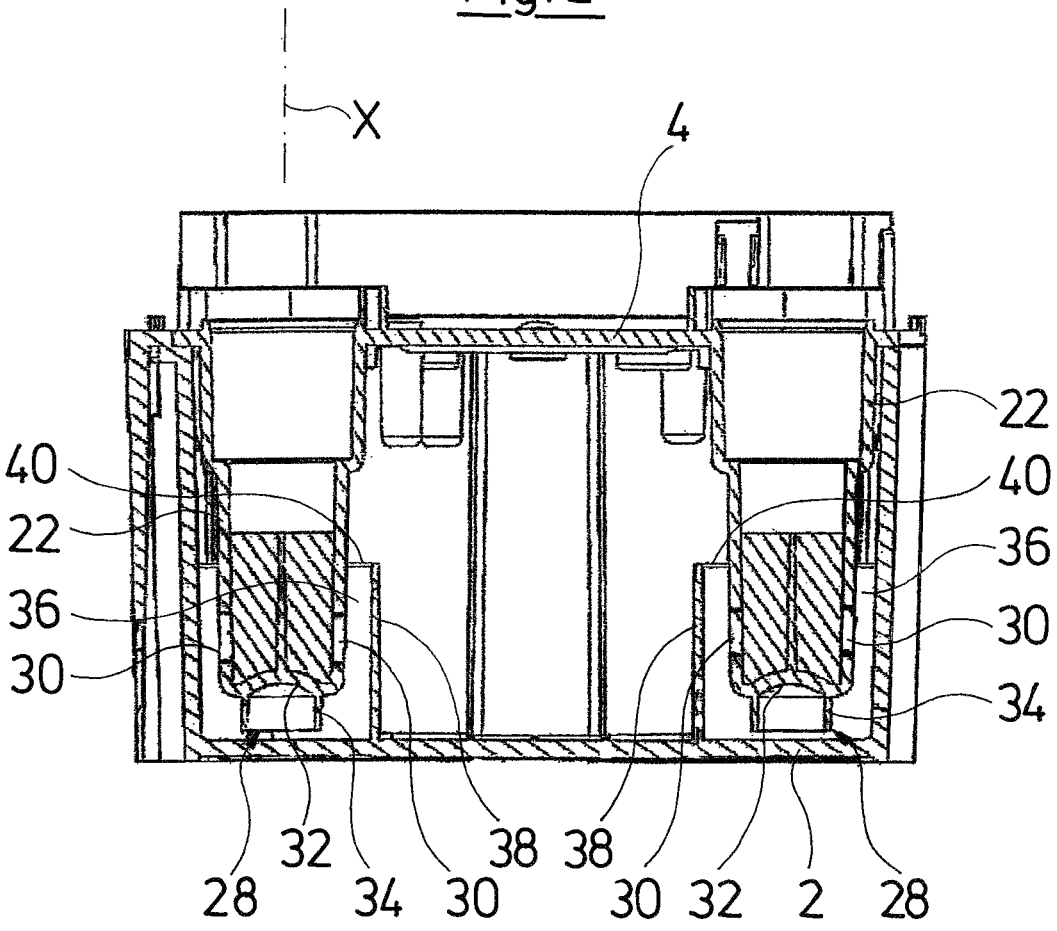
FIG. 2 is a sectioned view along the line II-II in FIG. 1.

Referring to the drawings in particular, the waste water lifting installation shown by way of example comprises a collection container 2 which is open to the top and which is preferably designed as a molded part of plastic. The collection container 2 at the upper side is closed by a flange plate 4 which forms a cover for the collection container 2. The flange plate 4 carries all essential components of the waste water lifting installation. Thus, in particular, it carries a pump assembly 6 with an electric motor 8 arranged above the flange plate 4 and with a pump 10 arranged below the flange plate 4. The pump 10 thereby is arranged such that it immerses into the inside of the collection container 2 and its impeller is situated as far as possible to the bottom in the inside of the collection container 2. Moreover, a float switch 12 is arranged on the flange plate 4 and serves for switching the pump assembly 6 on and off. The float switch 12 comprises a float 14 which is arranged in the inside of the collection container 2, i.e. below the flange 15 plate. The float 14 is connected via an actuation rod 16 to an electrical switch 18 situated above the flange plate 4. If the fluid level in the collection container 2 rises, the float 14 floats upwards and via the actuation rod 16 actuates the electrical switch 18, so that the electric motor 8 is switched on and the pump 10 is driven by this, so that fluid is delivered to the outside out of the collection container. If the fluid level in the collection container 2 sinks again, the float 14 also drops downwards and via the actuation rod 16 actuates the electrical switch 18 such that the electric motor 8 is switched off again.

The flange plate 4 at its four corners in each case comprises a vertically downwardly extending run-in pipe 22. The run-in pipes 22 in this case are designed as one piece with the flange plate 4 from plastic. In each case, a seal 24 is inserted into the upper opening of the run-in pipes 22 in the region of the flange plate 4, and this seal serves for sealing an inserted connection pipe 26. All four run-in pipes 22 are designed in an equal manner and may be selectively used for the connection of a connection pipe 26, depending on which direction the waste water is to be supplied to the collection container 2. The connection pipe 26 is simply inserted into the run-in pipe 22 from above and comes into sealing bearing contact on the inner periphery of the seal 24. The seal 24 with its outer periphery sealingly bears on the inner periphery of the run-in pipe 22.

The run-in pipes 22 are designed so long in the vertical direction X, that their lower ends 28 in the vertical direction X are distanced further from the flange plate 4 than the lower end of the float 14. In this manner, one succeeds in the flange plate 4 with the components attached thereto, in particular the float 14 and the pump 10, coming to stand on the lower ends 28 of the run-in pipes 22 and the float 14 ideally not coming into contact with the set-up surface, when the flange plate 4 is removed from the collection container 2 and placed onto a plane surface. Thus a damage to the float 14 or to the electrical switch 18 connected this via the actuation rod 16 is prevented when putting down the flange plate 4.

In the shown example, the run-in pipes 22 are no open at their lower ends 28 in a direct manner, but have radially directed exit openings 30 which in each case are distanced vertically to the top from the lower end 28. It is thus ensured that the exit openings, through which fluid or water flows into the collection container 2, are not situated directly on the base of the collection container 2, so that they may not become blocked due to contamination collecting at the base of the collection container 2. The run-in pipes 22 below the exit openings 30 have a closed end-wall 32 which extends in a transverse manner and from which an annular foot element 34 extends vertically downwards to the lower end 28. The end wall 32 in each case closes the flow path or flow channel in the inside of the run-in pipe 22, to the bottom.

The run-in pipes 22 engage with their lower end and the lower end section, in which the exit openings 30 are situated, in each case into a run-in chamber 36. The run-in chambers 36 are formed in the corners of the collection container 2 by separating walls 38 which extend vertically upwards from the base of the collection container 2 and connect to the side walls of the collection container 2. The separating walls 38 are designed as one piece with the walls of the collection container 2, preferably of plastic. Thus run-in chambers 36 are formed, which are only open to the top, wherein the upper end 40 of the run-in chambers 36 are situated above the upper edge of the exit openings 30 of the run-in pipes 22. A gas block is formed in this manner. The run-in chamber 36 firstly fills with a fluid up to the upper edge 40. The fluid then by way of flowing over the upper edge 40, runs into the remaining region of the collection container 2, in which the float 14 and the pump 10 are arranged. Thus one succeeds in the exit openings 30 of the run-in pipe always lying in the fluid, so that no gas may flow out of the run-in pipe 22 into the inside of the collection container 2. Should gas flow into the run-in pipe 22 through the connection pipe 26, then this may be effected through a gas exit opening 42, which is formed by a gap between the outer periphery of the seal 24 and the inner periphery of the run-in pipe 22 at its upper end.

This design of the gas block is particularly advantageous if the waste water lifting installation, as is envisaged with the shown waste water lifting installation, is used as a condensate lifting installation in a heating installation. With this application, there is the danger, in particular with a wrong installation, that waste gas flows out of the heating installation through the connection pipe 26 to the collection container 2. Since this waste gas contains aggressive substances, the waste gas should not enter into the inside of the collection container 2, which is prevented by the described gas block which is formed by the separating wall 38. Instead, the waste gas is then led away through the gas exits opening 42 into the surroundings.

Figure 3:
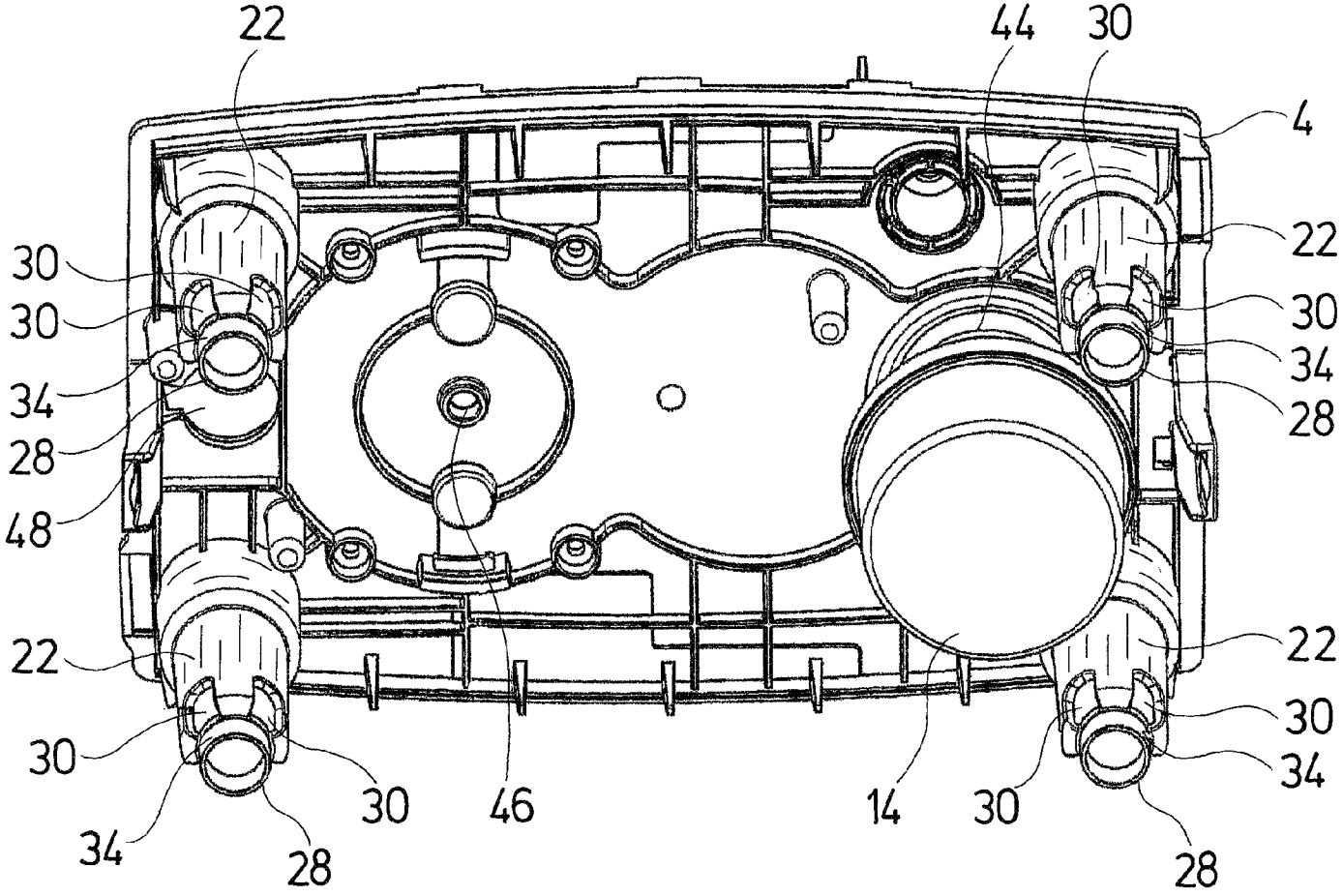
FIG. 3 is a perspective view of the flange plate from below.

As is to be seen in FIG. 3, the flange plate 4, apart from the run-in pipes, comprises only few openings, specifically an opening 44 through which the actuation rod 16 extends, and an opening 46 through which a shaft of the pump assembly extends from the electric motor 8 to the pump 10. Moreover, an opening 48 is provided, through which an exit conduit which is not shown here, may extend to the outside from the pump 10. It is only fastening openings which are yet provided.

While specific embodiments of the invention have been shown and described in detail to illustrate the application of the principles of the invention, it will be understood that the invention may be embodied otherwise without departing from such principles.

APPENDIX:

| List of reference numerals |
|---|
| 2 collection container |
| 4 flange plate |
| 6 pump assembly |
| 8 electric motor |
| 10 pump |
| 12 level or float switch |
| 14 float |
| 16 actuation rod |
| 18 electrical switch |
| 22 run-in pipe |
| 24 seal |
| 26 connection pipe |
| 28 lower end of the run-in pipe |
| 30 exit openings |
| 32 end-wall |
| 34 foot element |
| 36 run-in chamber |
| 38 separating walls |
| 40 upper edge |
| 42 gas exit opening |
| 44 opening |
| 46 opening |
| 48 opening |
| X vertical direction |

What is claimed is:

1. A waste water lifting installation comprising:

a collection container;

a flange plate arranged on an upper side of the collection container;

a level switch attached to the flange plate and extending into the collection container;

a run-in pipe extending from the flange plate vertically downwards into the collection container, the run-in pipe having a vertical length such that a lower end of the run-in pipe is vertically distanced further from the flange plate than a lower end of the level switch;

two additional run-in pipes to provide a multiplicity of run-in pipes arranged on the flange plate and extending from the flange plate into the collection container, wherein the run-in pipes have a vertical length such that a lower end of each of the run-in pipes is vertically distanced further from the flange plate than a lower end of the level switch when the level switch is in its lowest position, wherein each of said run-in pipes is formed integrally with the flange plate.

2. A waste water lifting installation according to claim 1, wherein the lower end of at least one of the run-in pipes forms a lowermost point of all components attached on the flange plate.

3. A waste water lifting installation according to claim 1, wherein at least one of the run-in pipes comprises at least one exit opening vertically distanced from the lower end of said at least one run-in pipe.

4. A waste water lifting installation according to claim 1, wherein at least one of the run-in pipes comprises a closed end-wall and comprises at least one exit opening situated in a peripheral wall of said at least one run-in pipe.

5. A waste water lifting installation according to claim 4, wherein at least one of the run-in pipes comprises a foot element extending from an end-wall vertically downwards up to the lower end of said at least one run-in pipe.

6. A waste water lifting installation according to claim 1, wherein the lower end of at least one of the run-in pipes engages into a run-in chamber of the collection container and together with the run-in chamber forms a gas closure.

7. A waste water lifting installation according to claim 1, wherein at least one of the run-in pipes has an upper end comprising at least one gas exit opening.

8. A waste water lifting installation according to claim 7, further comprising a seal inserted into the upper end of at least one of the run-in pipes, wherein the gas exit opening is formed between the seal and a peripheral wall of said at least one run-in pipe.

9. A waste water lifting installation according to claim 8, further comprising a connection pipe inserted into at least one of the run-in pipes, wherein the seal sealingly bears on or may be brought into sealed bearing contact on the outer periphery of the connection pipe.

10. A waste water lifting installation according to claim 1, wherein the waste water lifting installation comprises condensate lifting installation for application in a heating installation or an air-conditioning installation.

11. A waste water lifting installation comprising:

a collection container;

a flange plate arranged on an upper side of the collection container;

a level switch attached to the flange plate and extending into the collection container;

a plurality of run-in pipes extending from the flange plate vertically downwards into the collection container, each of said run-in pipes having a vertical length such that a lower end of each of said run-in pipes is vertically distanced further from the flange plate than a lower end of the level switch when the level switch is in its lowest position, each of said run-in pipes being integrally connected with said flange plate to form a one-piece flange plate and run-in pipes structure.

12. A waste water lifting installation according to claim 11, wherein one or more of the run-in pipes comprises a closed end-wall and one or more of the run-in pipes comprises at least one exit opening situated in a peripheral wall of the one or more run-in pipes.

13. A waste water lifting installation according to claim 12, wherein one or more of the run-in pipes comprises a foot element extending from an end-wall vertically downwards up to the lower end of the one or more of the run-in pipes.

14. A waste water lifting installation according to claim 11, wherein each of said run-in pipes defines at least a portion of a fluid flow path for delivering fluid to said collection chamber.

15. A waste water lifting installation according to claim 11, wherein said flange plate is connected to said collection chamber in a connected state, said flange plate being located at a spaced location from said collection chamber in a disconnected state, said run-in pipes and said level switch remaining connected to said flange plate in said disconnected state.

16. A waste water lifting installation comprising:

a collection container;

a flange plate arranged on an upper side of the collection container;

a level switch attached to the flange plate and extending into the collection container;

a first run-in pipe;

a second run-in pipe;

a third run-in pipe, each of said first run-in pipe, said second run-in pipe and said third run-in pipe being located opposite another one of said first run-in pipe, said second run-in pipe and said third run-in pipe, each of said first run-in pipe, said second run-in pipe and said third run-in pipe having a vertical length such that a lower end of each of said first run-in pipe, said second run-in pipe and said third run-pipe is vertically distanced further from the flange plate than a lower end of the level switch when the level switch is in its lowest position, each of said first run-in pipe, said second run-pipe and said third run-in pipe being integrally connected with said flange plate to form a one-piece flange plate and run-in pipes structure, each of said first run-in pipe, said second run-in pipe and said third run-in pipe defining at least a portion of a fluid flow system, wherein fluid is delivered to said collection chamber via one or more of said first run-in pipe, said second run-in pipe and said third run-in pipe.

17. A waste water lifting installation according to claim 16, wherein one or more of said first run-in pipe, said second run-in pipe and said third run-in pipe comprises a closed end-wall and one or more of said first run-in pipe, said second run-in pipe and said third run-in pipe comprises at least one exit opening situated in a peripheral wall of the one or more of said first run-in pipe, said second run-in pipe and said third run-in pipe.

18. A waste water lifting installation according to claim 17, wherein one or more of said first run-in pipe, said second run-in pipe and said third run-in pipe comprises a foot element extending from an end-wall vertically downwards up to the lower end of said first run-in pipe, said second run-in pipe and said third run-in pipe.

19. A waste water lifting installation according to claim 16, wherein said flange plate is connected to said collection chamber in a connected state, said flange plate being located at a spaced location from said collection chamber with said flange plate disconnected from said collection chamber, said run-in pipes and said level switch remaining connected to said flange plate with said flange plate disconnected from said collection chamber.

* * * * *